US008567447B2

(12) United States Patent
Montoya Treviño

(10) Patent No.: US 8,567,447 B2
(45) Date of Patent: Oct. 29, 2013

(54) MULTIPARTITE MECHANICAL PRESS FOR FLANGED CONNECTIONS WITH WEDGE-ACTUATED MOVEMENT MECHANISM

(75) Inventor: Alberto Montoya Treviño, San Nicolás de los Garza (MX)

(73) Assignee: Industria Regiomontana Quantron, S.A. de C.V., Nuevo Leon (MX)

( * ) Notice: Subject to any disclaimer, the term of this patent is extended or adjusted under 35 U.S.C. 154(b) by 0 days.

(21) Appl. No.: 13/508,978

(22) PCT Filed: Jan. 21, 2010

(86) PCT No.: PCT/MX2010/000005

§ 371 (c)(1),
(2), (4) Date: Jul. 25, 2012

(87) PCT Pub. No.: WO2011/059303

PCT Pub. Date: May 19, 2011

(65) Prior Publication Data

US 2012/0279598 A1 Nov. 8, 2012

(30) Foreign Application Priority Data

Nov. 10, 2009 (MX) ..... MX/A/2009/012178

(51) Int. Cl.
*F16L 55/10* (2006.01)
*F16K 3/312* (2006.01)

(52) U.S. Cl.
USPC ..... 138/94.3; 138/94.5; 138/109; 251/197; 137/454.2

(58) Field of Classification Search
USPC ..... 138/94.3, 94.5, 109; 137/454.2, 454.6; 251/196, 197
See application file for complete search history.

(56) References Cited

U.S. PATENT DOCUMENTS

| | | | | | |
|---|---|---|---|---|---|
| 2,083,582 | A * | 6/1937 | Taylor et al. | ..... | 137/1 |
| 2,954,960 | A * | 10/1960 | Dunbar et al. | ..... | 251/196 |
| 3,598,154 | A * | 8/1971 | Brundage | ..... | 138/94.3 |
| 3,743,244 | A * | 7/1973 | Dickenson et al. | ..... | 251/197 |
| 3,929,316 | A * | 12/1975 | Guthrie | ..... | 251/196 |
| 4,343,332 | A * | 8/1982 | Williams et al. | ..... | 138/94.3 |
| 4,408,636 | A * | 10/1983 | Karpenko | ..... | 138/94 |
| 5,083,582 | A * | 1/1992 | Lawson | ..... | 137/454.6 |
| 5,217,073 | A * | 6/1993 | Bruns | ..... | 166/298 |
| 5,232,199 | A * | 8/1993 | Thrasher | ..... | 251/196 |
| 5,488,902 | A * | 2/1996 | Dorenkamp | ..... | 101/216 |
| 7,469,709 | B2 * | 12/2008 | Bridgeford et al. | ..... | 137/271 |
| 7,654,287 | B1 * | 2/2010 | Metzger et al. | ..... | 138/94.3 |

* cited by examiner

*Primary Examiner* — Patrick F Brinson
(74) *Attorney, Agent, or Firm* — Parsons & Goltry; Michael W. Goltry; Robert A. Parsons

(57) ABSTRACT

A multipartite mechanical press is presented, preferably bipartite for flanged connections that allows the handling of flanged connections on pipes for addition/removal of elements to/from the line, such as filters, plates, flow regulators, measurement elements, orifice plates and valves. The multipartite design allows a totally mechanical installation, without the need for any type of modification to the pipeline, or by destructive procedures of removal or addition of material. For installation of the multipartite mechanical press requires the existence of flanged connections in the pipel in question. The operation of the press is totally manual, i.e. operation does not require the use of mechanisms activated by any electrical, pneumatic, fuel-based, etc. means.

11 Claims, 3 Drawing Sheets

MULTIPARTITE MECHANICAL PRESS FOR FLANGED CONNECTIONS WITH WEDGE-ACTUATED MOVEMENT MECHANISM

OBJECT OF THE INVENTION

The present invention relates to a device for handling the pipes with flanged connections, which mechanism is a multipartite mechanical press, preferably a bipartite press, in which the multipartite design provides a means for its installation that does not require any destructive processes, removal or addition of material, removal of pipes, or any changes in the process line.

Next, there's a variation to the opening mechanism implemented for the device called "multipartite mechanical press for flanged connections", patent pending under number MX/a/2009/008629. Said mechanism allows a more compact and efficient design of the multipartite mechanical press for flanged connections, reduced manufacturing costs and complexity of components and ease of installation and use.

BACKGROUND

There are devices that are used as auxiliaries for the handling and/or modification of pipelines, whose purpose is to adhere materials for treating and/or measurement of the fluid passing through the pipe. These devices often involve the modification of the pipe through destructive processes, or the addition of material, such as cutting or welding, modifying the original design of the line, and the properties thereof.

Some devices similar to that shown in the present patent are mentioned below, as the one entitled "Open flange device" (JP09112768). This patent shows a mechanism for mounting and removing apparatus for water treatment in flanged pipes, exerting a pressure in opposite directions in each of the flanges, thus forming a space which allows mounting or removal of such devices; however for the installation of this mechanism it is necessary to modify the pipes in order that the flanges have a plate with holes to allow mounting said mechanism.

Another similar patent is entitled "Three-wedge double block Isolation chamber" (U.S. Pat. No. 7,469,709). This invention provides a device that is added to a pipeline with flanged connections, which can be configured in three different ways; it can be configured for the flow to freely pass, for a total blocking, or to measure the liquid flow through the pipe. These types of devices can be mounted on a pipe with flanged connections using the invention disclosed in this patent.

Other locking mechanisms in accordance with characteristics of the present patent application can be seen below, the patent entitled "Cut-and-close device for pressure pipes and production and supply installations" (U.S. Pat. No. 5,217,073), which consists of a two-piece press, which is placed on a pipe and allows the introduction of a plate which cuts and seals the pipe, said plate is introduced due to the pressure generated by a propellant load and a piston. This mechanism is destructive and implies serious modifications in the pipes. Other similar locking mechanisms can be found in patents "Line Blind Valve" (U.S. Pat. No. 3,598,154) and "Line blind" (U.S. Pat. No. 4,343,332).

DETAILED DESCRIPTION OF THE INVENTION

The multipartite mechanical press, preferably bipartite for flanged pipe lines, in accordance with the present invention is intended to provide a means for handling flanged pipes, serving as a tool that allows mounting and dismounting of additional devices on the line, such as filters, plates, flow regulators, measuring elements, orifice plates and valves.

This device offers the following advantages:

- The possibility of a completely mechanical installation, which does not imply any changes to the process line.
- A minimal use of tools for its installation.
- There are no different levels that may cause cavitation.
- No maintenance of any kind required.
- Less connection points where there may be leakage in comparison to conventional devices.
- The assembly time is 2 hours man, as compared with the conventional devices that require between 48 and 62 hours man.
- No tools required nor any mechanical, electrical, pneumatical devices or any other type to operate transmission that activates the opening/closure of the mechanism of the multipartite mechanical press for flanged connections.
- The manual activation of the mechanism does not require any excessive effort on behalf of the operator, including it can be handled by one person only.
- The time required to completely open/close the press is minimal compared to other existing devices on the market.

Figure 1:
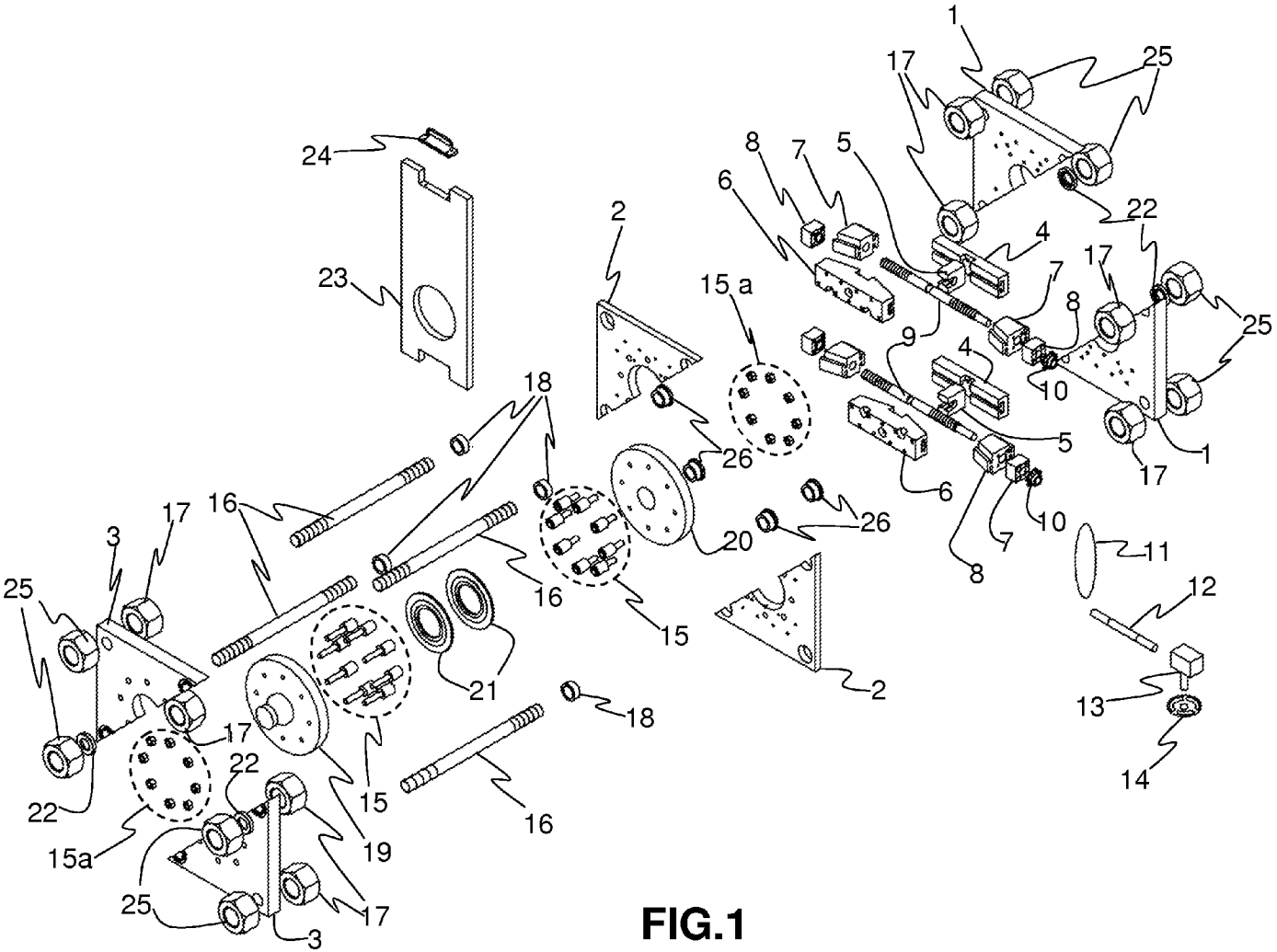
FIG. 1: Exploded view of the multipartite mechanical press for pipelines with flanged connections.
Figure 2:
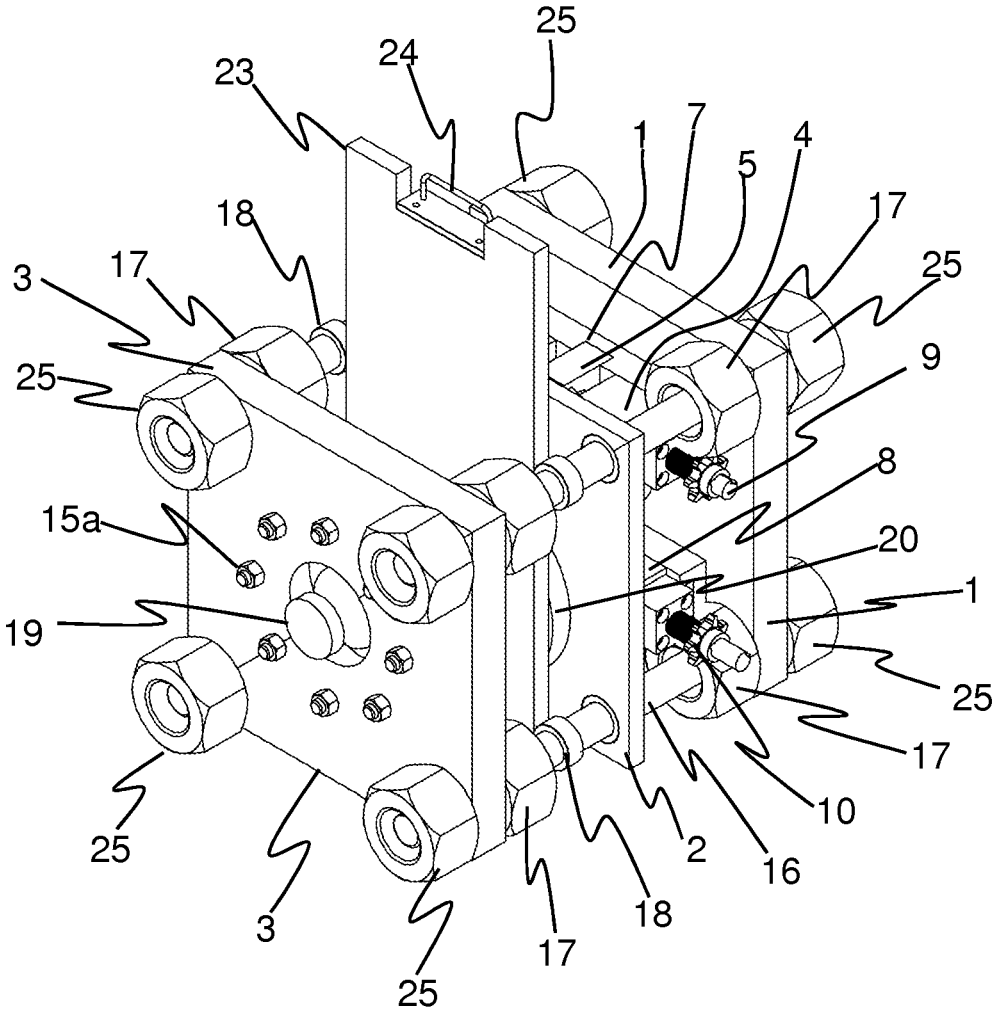
FIG. 2: Perspective view of the multipartite mechanical press for pipelines with flanged connections.
Figure 3:
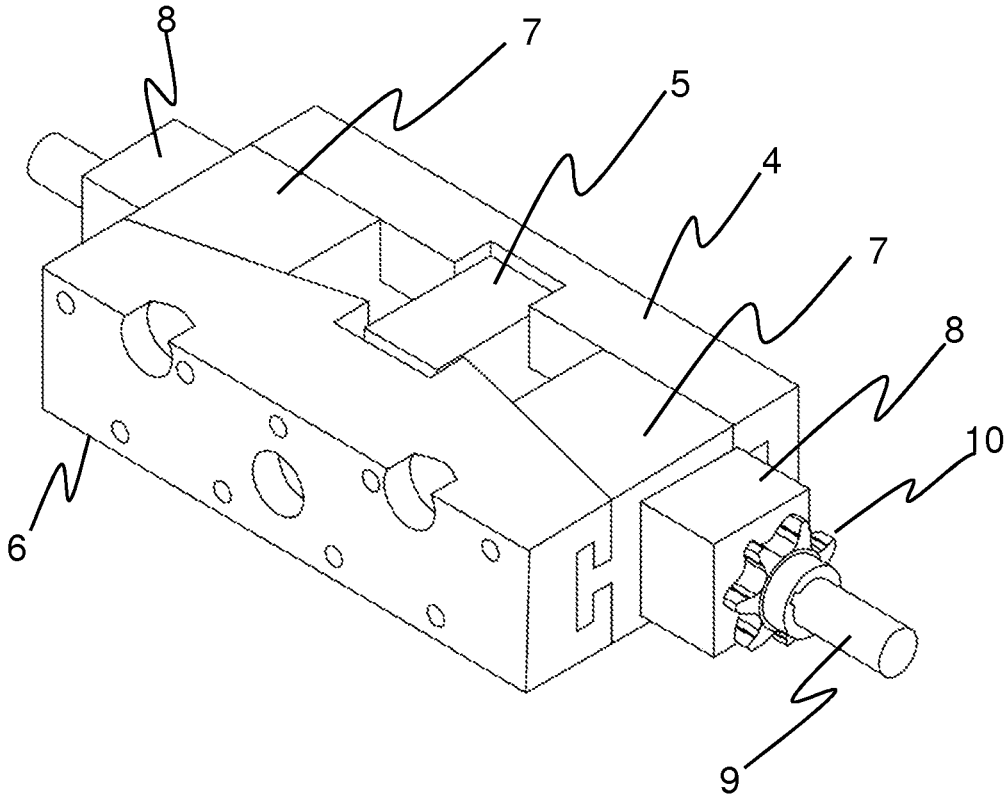
FIG. 3: Detailed view of the mechanism for opening/closing wedges.

The multipartite mechanical press for pipes with flanged connections (FIG. 2) consists mainly of the following components (FIG. 1 for number references): three multipartite support plates, preferably bipartite: base plate (1), movable plate (2) and support plate (3), two straight crossbars (4), with a cavity in the middle and slots along the vertical length on the opposite side to the fixed side on the support plate (3), said straight crossbar (4) are placed vertically, one at each end thereof; in the cavity of each straight crossbar (4) is placed an insert in a "C" shape (5) which has an unevenness in the interior part of the protrusion "C" and allows the correct positioning of a screw with opposite threads (9), which in a certain section of one of the ends thereof has a right-hand thread, while a certain section of the opposite end has a left-hand thread, and in its middle section that has no thread, there is a smooth finish section of a smaller diameter than the rest of the screw body, whose function is to fit in the unevenness of the protrusion "C" of the insert (5); opposite to each straight crossbars (4) is positioned a crossbar with opposite inclined planes (6), having a total of two in the system, said planes have slots in their middle part that are coincident with a slot present in the straight crossbars (4) and allow the insert in a "C" shape (5) can stay in this slot when required, each crossbar with opposite inclined planes (6) is secured at its vertical side to the movable plate (2), one at each end thereof, opposite to this face there are inclined planes, said planes are showing vertical slots over their entire length.

Coupled to the slots in each straight crossbar (4) and crossbar with an inclined plane (6) and with the narrowest faces in front of each other, there are a couple of wedges (7), with a total of four in each system; both faces, the inclined and vertical one, both presenting protrusions in a "T" shape which are used to engage into the slots of each crossbar (4, 6) and can slide, each wedge (7) has a smooth hole which passes from one end to the other starting from the narrow face to the broad face, and an amount of threaded holes in the broad face with a given depth, which are used to mount a clamping blocks (8), which has a threaded hole passing along its length and is concentric to the smooth hole of the wedge (7), said threaded hole allows the coupling of a screw with opposite threads (9), which at a given end a gear (10) is placed, having a total of two gears (10) that are in the same plane and are joined together by means of a chain (11); a gear (10) is accopled to a drive shaft (12) for transmitting the motion generated from a flywheel (14) utilizing a transmission (13), originating a simultaneous movement of both gears (10) by the chain (11); said rotational movement of the gear (10) and chain (11) causes rotation of the screws with opposite threads (9), converting this movement into a linear displacement movement of the clamping blocks (8), which in turn causes linear movement in opposite directions of the wedges (7); said linear displacement in opposite directions causes the distance between the straight crossbar (4) and the crossbar with opposite inclined planes (6) to which the wedges (7) are attached increases or decreases, depending on the direction of movement thereof; this change in distance between the straight crossbar (4) and the crossbar with opposite inclined planes (6) in turn causes the distance between the movable plate (2) and the base plate (1) to vary, thus allowing the introduction or removal of the pipe elements, for example, of a locking plate (23).

The system has four threaded bars (16) whose function is to support the mechanism and also as a guide for the movable plate (2); these are fixed to the plates (1, 3) by nuts (25) at the outer ends of the base plate (1) and the support plate (3) and with locknuts (17) and the inner faces of said plates, allowing the movable plate (2) free to move into the holes of this plate, there are four bushings (26), which help to prevent wear of the threaded bars (16), also with guide rollers (18), which serve as auxiliaries for the introduction/extraction of the elements that are added to the pipes.

Besides these elements, the multipartite mechanical press uses and takes advantage of the existing elements in the pipelines with flanged connections for its operation, which are a pair of flanges, called for the application presented here as fixed flange (19) and a movable flange (20) and metal washers between the faces of these, to be known for this particular case as metallic seals (21) since this is their function in the system. On the other hand, there are elements that are added to the pipeline; in the figures there is a diagram of a locking plate (23), which has two fasteners (24) for easier handling.

In the multipartite mechanical press for pipelines with flanged connections (FIG. 2), each of the parts of the base plate (1) and movable plate (2), are connected by means of a set of fasteners (15, 15*a*) to the fixed flange (19) and movable flange (20), respectively; said fasteners (15, 15*a*) are designed such that they prevent the existence of protuberances which may cause separation at the time of closing the press, thus eliminating the possibility of wrinkles due to these elements. The movable plate (2) serves as a central support for multipartite mechanical press. In each of the four threaded bars (16), between the movable plate (2) and the support plate (3) are placed guide rollers (18), which together allow that the displacement of the element that is fit between the flanges (19, 20) is simpler: the length of the threaded bars (16) depends on the element that you want to mount on the pipeline. By means of the threaded bars (16) the mounted components are integrated on the fixed flange (19) with the mounted components on the movable flange (20), passing each of the four threaded bars (16) through each of the four holes on each of the multipartite plates (base (1), movable (2) and support (3)); locknuts (17) are used for fixing each of the threaded bars (16) at one end to the base plate (1), and at the other end to the support plate (3). Additionally, washers (22) are used at each of the ends of the diagonal formed by assembling the two parts of multipartite plates (1, 3), as auxiliaries to hold them together, these washers (22) are used only on the base plate (1) and support plate (3) and placed between them and the nut (25); its primary function is to assist the parties to maintain multipartite plates (1, 3) together by the pressure generated by the nuts (25) when tightened. The whole of this structure offers rigidity to the multipartite mechanical press and the clamping necessary to ensure that the movable plate (2) is the only one that can move when using the press and both the base plate (1) as the support plate (3) remain fixed, and thus the pressure required to open the pipe can be generated by the mechanism of the mechanical press without a risk of malfunction.

The mechanical press mechanism of the multipartite mechanical press for pipelines with flanged connections is based on the conversion of the rotary motion induced by a flywheel (14) toward the gears (10) whose movement, also rotating, causes the rotation of the screws with opposite threads (9) to provoke a vertical linear displacement in opposite directions of the pairs of wedges (7), so that it becomes a horizontal displacement (approaching/pulling apart) between the movable plate (2) and the support plate (3). It is due to the pressure exerted by the inclined planes of the wedges (7) on the bars (4) and (6) that the invention is called "multipartite mechanical press for flanged connections with movement mechanism actuated by wedges". Once the movable flange (20) has moved sufficiently, the element to be introduced in the flanged connection of the pipeline in question can easily be placed using guide rollers (18); in FIGS. 1 and 2 there is a scheme of the addition of a locking plate (23) which has two fasteners (24) for major ease of handling. The existence of metallic seals (21) in each of the flanges reduces the risk of leaks in the connection.

The design of the mechanical press can have fewer joints where leakage may exist, thus increasing the safety in the pipeline and decreasing the generation of waste in the process.

The elements of the multipartite mechanical press for pipelines with flanged connections are designed based on the standards of ANSI b16.5 corresponding to pipe flanges and flanged connections, ASME Section 2 and ANSI b 16.34. API 598. The standard ANSI b16.5 is characterized by the selection criteria of the thickness of the flange, the number of studs and the diameters thereof; based on this, the force of opening and closing of the multipartite mechanical press was calculated which reaches the same torque exerted by the number of studs according to the diameter of each flange; in the case of a pipeline of 2 inches, 600 pounds of pressure, Class ANSI and 8 studs, these exert a closing force of 27.552 pounds, which is equal to that exerted by the mechanism presented herein.

Using the ASME standard, the building materials of the multipartite mechanical press were as follows: Steel 10/45, 41/40, OI 86/20 stainless 3/16 and bronze. Ansi standard b 16.34 API 598 allowed carrying out satisfactorily the pressure and leakage tests.

The invention claimed is:

1. A multipartite mechanical press for pipelines with flanged connections comprising a fixed flange, a movable flange, and metallic seals; wherein said multipartite mechanical press includes:

a base plate multipartite;

a support plate multipartite fixed to said base late multipartite;

a movable plate multipartite positioned between said base plate multipartite and said support plate multipartite;

a pair of straight crossbars, wherein each straight crossbar is slotted longitudinally on a face opposite to that one fixed to the base plate;

a pair of crossbars with opposite inclined planes, wherein each crossbars with opposite inclined planes is slotted longitudinally on its inclined face opposite to its straight face, which is fixed to said movable plate;

a pair of screws with opposite threads, that is, with a right-hand thread along a given section of one end and a left hand thread along a given section at the other end; and two pairs of wedges with a wide face, a narrow face, a inclined face, and a opposite face to it, wherein each wedge is inserted in each said screw with opposite threads by a threaded hole which passes from the wide face to a narrow face, and the inclined face and the opposite face has protruding T-sections which inserted into the slots of said straight crossbar and said crossbar with opposite inclined planes, so that it slides in a guided way; and wherein additionally, said multipartite mechanical press takes advantage of the fixed flange, the movable flange and the metal seals of said flanged connection of the pipeline.

2. The multipartite mechanical press of claim 1, wherein said base plate multipartite, said movable plate multipartite, and said support plate multipartite are bipartite.

3. The multipartite mechanical press of claim 1, wherein further each said straight crossbar and each crossbars with opposite inclined planes has a slot in its middle section and a semicircular cut in one of its sides, and said screws with opposite threads has a unthreaded section to position a insert in a "C" shape in said slot in the middle section, wherein said insert in a "C" shape is grooved on the inside of its protrusion "C" and one of its faces has a curvature.

4. The multipartite mechanical press of claim 1, wherein further includes two pairs of clamping blocks with threaded holes for said screws with opposite threads and one threaded hole which passes from one end to the other of the block, these holes are aligned with respective said wedges.

5. The multipartite mechanical press of claim 1, wherein said base plate multipartite and said support plate multipartite are fixed by threaded bars, and said movable plate multipartite is movable in said threaded bars.

6. The multipartite mechanical press of claim 5, wherein further includes guide rollers on said threaded bars, placed between the movable plate and the support plate as a mechanism to help the insertion of elements in said flanged connection.

7. The multipartite mechanical press of claim 1, wherein further includes:

a pair of gears positioned at only one end of said each said screw with opposite threads;

a chain which connects both gears; and a transmission.

8. The multipartite mechanical press of claim 7, wherein further includes a drive shaft for transmitting the motion of said transmission toward said gear and thus to the corresponding screw with an opposite thread in which it is mounted.

9. The multipartite mechanical press of claim 7, wherein further includes a flywheel for generating the input motion to the transmission.

10. The multipartite mechanical press of claim 1, wherein further includes fasteners between the movable flange of the flanged connection of the pipeline and the movable plate, which lie flush with the face of the movable flange, thus avoiding any possibility of separation between the faces of both flanges to be in contact and therefore the risk of leakage of material.

11. The multipartite mechanical press of claim 1, wherein further includes fasteners between the fixed flange of the flanged connection of the pipeline and the base plate, which lie flush with the face of the fixed flange, thus avoiding any possibility of separation between the faces of both flanges to be in contact and therefore the risk of leakage of material.

* * * * *